US006209786B1

(12) United States Patent
Yelton et al.

(10) Patent No.: US 6,209,786 B1
(45) Date of Patent: Apr. 3, 2001

(54) READILY OPENABLE SHIPPING AND DISPLAY CONTAINER

(75) Inventors: Donald W. Yelton, Villa Hills, KY (US); James T. Fenton, West Chester; Mark R. Butscha, Cincinnati, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/369,092

(22) Filed: Aug. 5, 1999

(51) Int. Cl.[7] ..... B65D 5/54

(52) U.S. Cl. ..... 229/241; 229/120.38; 229/240; 229/242

(58) Field of Search ..... 229/120, 38, 240, 229/241, 242; 206/746, 774

(56) References Cited

U.S. PATENT DOCUMENTS

| | | | | |
|---|---|---|---|---|
| 1,925,102 | * | 9/1933 | Levkoff | 206/746 |
| 2,747,788 | | 5/1956 | Tilly . | |
| 2,816,699 | | 12/1957 | Nute . | |
| 3,228,582 | * | 1/1966 | Osberg | 229/242 |
| 3,447,735 | | 6/1969 | Whitney . | |
| 3,756,502 | * | 9/1973 | Swanson et al. | 229/242 |
| 5,464,149 | * | 11/1995 | Fowler et al. | 229/120.38 |
| 5,505,371 | * | 4/1996 | O'Neill | 229/242 |
| 5,918,801 | * | 7/1999 | Milio | 229/240 |
| 5,957,294 | * | 9/1999 | Kanter | 206/774 |

FOREIGN PATENT DOCUMENTS 2162063 7/1973 (FR) .

* cited by examiner

*Primary Examiner*—Gary E. Elkins
(74) *Attorney, Agent, or Firm*—Michael S. Kolodesh; David M. Weirich; Ken K. Patel

(57) ABSTRACT

Disclosed is a container for shipping, display, and subsequent removal of a plurality of articles. The container includes a first surface having two oppositely extending flaps folded towards each other. Each of the flaps has a proximal end and a distal end. The distal ends of the flaps are oppositely disposed and form a flap gap therebetween. The container further includes a line of weakness having two ends. Each end of the line of weakness is juxtaposed with at least one of the distal ends of the flaps. The line of weakness extends therefrom to intercept at least one panel of the container adjacent one of the flaps. The line of weakness may include perforation lines having a multiplicity of cuts and skips. The line of weakness defines a removable segment, which may be removed by tearing along the perforation lines. The flap gap between the distal ends of the flaps provides an opening for the hand access to remove the removable segment of the container. Carton blanks used to form the containers are also disclosed.

12 Claims, 9 Drawing Sheets

READILY OPENABLE SHIPPING AND DISPLAY CONTAINER

FIELD OF THE INVENTION

This invention relates to containers which may be used for shipping a plurality of products and optionally converted to an open container suitable to display the products for individual use. Further, the invention relates to containers having a flap gap and a tear out section, removal of which enables both display and removal of articles contained therein. Further, the invention relates to carton blanks for containers of this type.

BACKGROUND OF THE INVENTION

Containers such as cardboard cartons are generally used to package and ship a plurality of individually wrapped or packaged articles such as consumer products. It would be convenient and desirable for these containers to have a readily openable or removable panel that would allow access to the contents of a container. There is also a need in the packaging art to economize the cost of such containers by using in their construction the smallest amount of materials possible, consistent with the volume and strength required for the container.

One type of container known in the art is shown in U.S. Pat. No. 4,946,042 issued Aug. 7, 1992 to Ferreri et al. Ferreri et al. disclose a shipping and display carton having panel top flaps divided into two sections. The panel top flaps meet in the center of the top of the package, thus forgoing any opportunity any economize with respect to the amount of the material used to form the carton. Furthermore, Ferreri et al. require requires a separate operation to cut out a notch in the top flaps for access to the contents of their carton.

Commonly assigned U.S. Pat. No. 5,657,872 issued Aug. 19, 1997 to Leftwich et al., which patent is incorporated herein by reference, discloses a shipping/display container. This shipping/display container has a tray portion and a removable cover portion. Again, the cover portion entirely encloses the contents of the container and does not provide for any economization in the cost of its materials. Further, Leftwich et al. also require a separate operation to add the cover and then to add the lines of weakness to the cover on their carton.

Yet another type of carton is shown in U.S. Pat. No. 3,899,126 issued Aug. 12, 1975 to Palmer , which patent is incorporated herein by reference. Palmer discloses a carton having a panel formed with a pair of lines of weakness extending at a 45° inclination between fold lines. However, Palmer fails to teach multi-panel access to the contents of his display carton and further, again, fails to teach a way to minimize the amount of materials used in making the carton. A similar example is shown in U.S. Pat. No. 5,011,021 issued Apr. 30, 1991 to Coltrane et al. Coltrane et al. disclose a carton having lines of separation at the corners defining one side panel. Again, Coltrane et al. fail to disclose lines of weakness which provide for multi-panel access to the carton and fail to economize o n materials as is known in the art.

Material economization has been separately practiced in the container or carton art through the use of flap gaps. A flap gap is the space left between opposite flaps on a common panel, which flaps are folded towards each other. The distal ends of the oppositely folded flaps do not meet, allowing a space in which the contents of the container can be seen between the distal ends of the flaps. Such a space between the distal ends of the flaps is known as a flap gap. Such flap gap economization has been practiced on the commercially successful BOUNTY™ paper towel shipping containers. However, such containers have not allowed for specific and predetermined access to the container contents by consumers or by personnel who remove the container contents for stocking at the point of purchase.

Given the foregoing, there exists a continuing need in the art to provide a shipping container which allows for easy and convenient multi-panel access, optionally multi-panel access at the juncture of adjacent panels, as well as economization of materials. Further, it would be desirable to have multi-panel access which has the flexibility to allow access to anywhere from two to five panels of a generally parallelepipedly shaped container. Such a need is satisfied by the containers and carton blanks of the present invention.

SUMMARY OF THE INVENTION

The present invention provides a container or a carton for shipping, display, and subsequent removal of a plurality of articles. The container includes a first surface, generally the top of the container, having two oppositely extending flaps folded towards each other. Each of these flaps has a proximal end and a distal end. The distal ends of the flaps are oppositely disposed and form a flap gap between them. The container further includes a line of weakness having two ends. Each end of the line of weakness is juxtaposed with at least one of the distal ends of the flaps. The line of weakness extends from the distal ends of the flaps to intercept at least one panel of the container which is adjacent to one of the flaps. A segment of the container can be torn away along the line of weakness to expose the plurality of articles therein and to permit removal of the articles from the container. The present invention also provides carton blanks from which the containers herein can be formed.

DETAILED DESCRIPTION OF THE INVENTION

Figure 1:
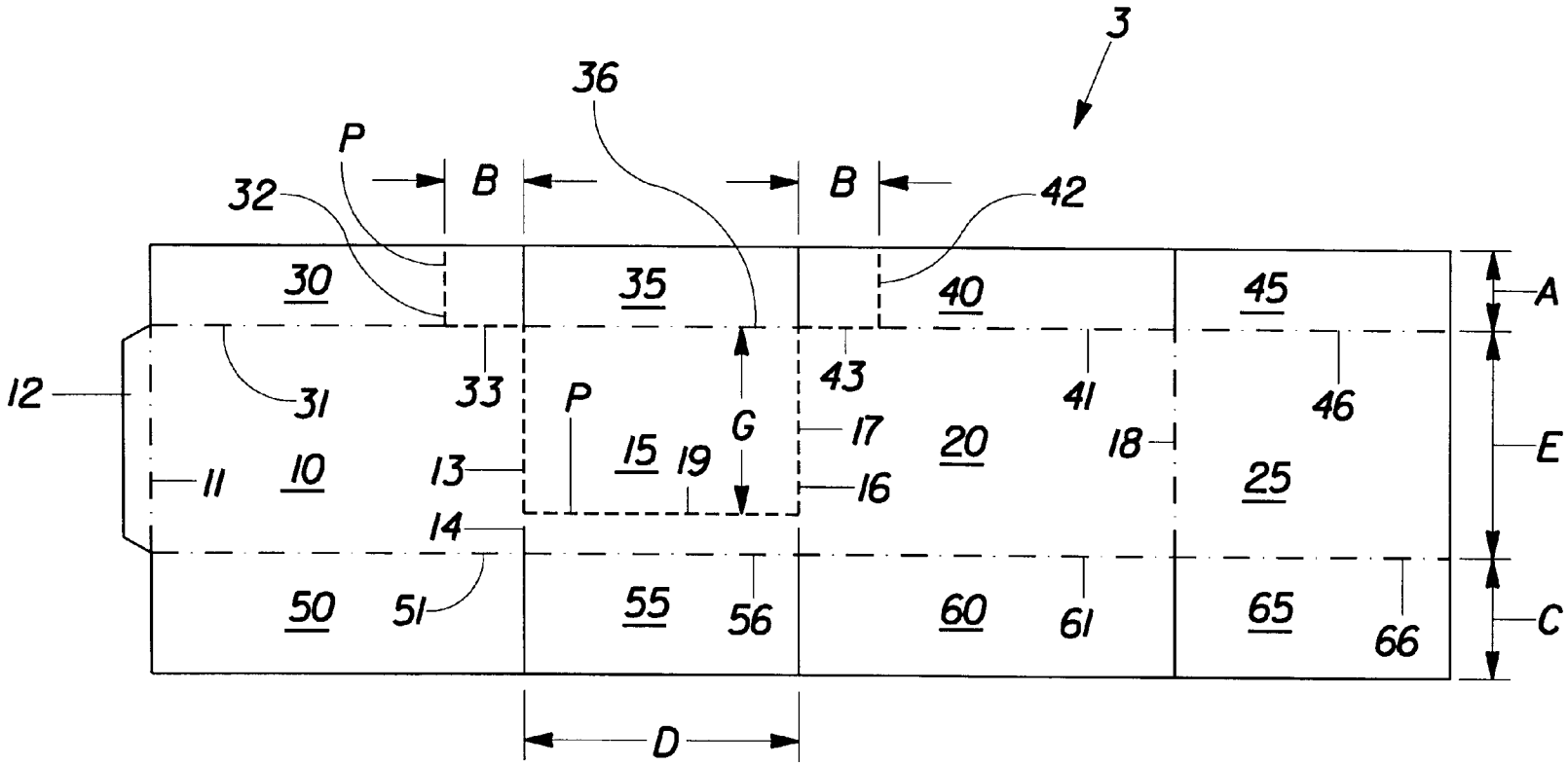
FIG. 1 is a plan view of one form of a carton blank of the present invention, which carton blank represents the container in a flat unfolded state.

Referring now to the drawings, FIG. 1 illustrates a carton blank 3 of one preferred embodiment of the present invention. The carton blank 3 comprises a first side panel 10, a front panel 15, a second side panel 20, and a rear panel 25.

The first side panel 10 is integrally formed with a first side panel top flap 30 and a first side panel bottom flap 50 along fold lines 31 and 51, respectively. The front panel 15 is connected to the first side panel 10 along a fold line 14 and is integrally formed with a front panel top flap 35 and a front panel bottom flap 55 along fold lines 36 and 56, respectively. The second side panel 20 is connected to the front panel 15 along a fold line 16 and is integrally formed with a second side panel top flap 40 and a second side panel bottom flap 60 along fold lines 41 and 61, respectfully. The rear panel 25 is connected to the second side panel 20 along a fold line 18 and is integrally formed with a rear panel top flap 45 and a rear panel bottom flap 65 along fold lines 46 and 66, respectfully. The carton blank 3 preferably further comprises a side flap 12 which is integrally connected to the first side panel 10 along a fold line 11. The side flap 12 is adapted for fastening the first side panel 10 to the rear panel 25 as to form a hollow sleeve.

Figure 2:
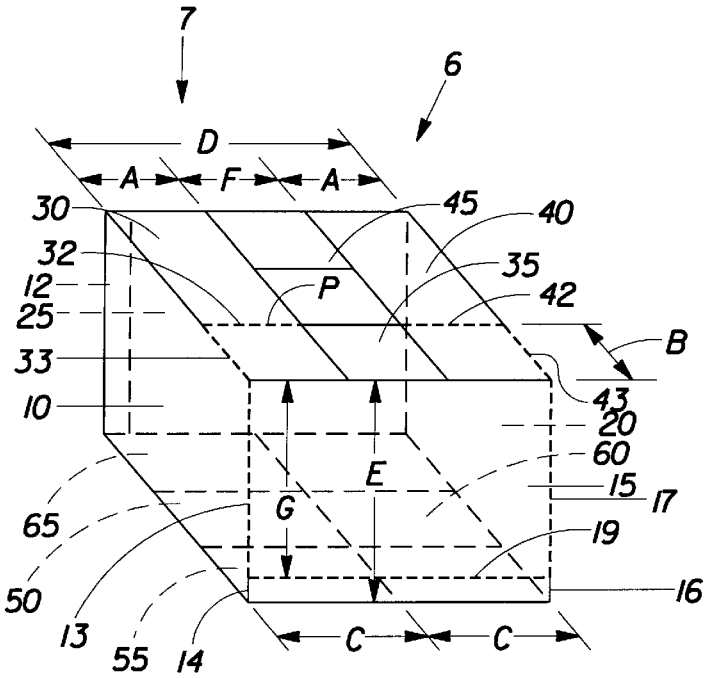
FIG. 2 is a perspective view of the carton blank of FIG. 1 in a folded closed state so as to form the container of the present invention.

In a preferred embodiment of the present invention, the container is configured to have a flap gap F between the top flaps 30 and 40 when the flaps are folded toward each other to form a surface 7, as shown in FIG. 2. In any particular construction, the width of the top flaps 30 and 40, which is depicted by a letter A in FIGS. 1 and 2, is a factor for providing the width of the flap gap F. The width of the flap gap F may be in the range of approximately 2 inches to 6 inches, and preferably approximately 4 inches wide.

Referring specifically to FIG. 2, there can be two separate flap gaps. The first flap gap occurs between folded in top flaps 30 and 40, and the second flap gap is formed in similar fashion by folding in the top flaps 35 and 45. The flap gaps are oriented differently, preferably at a 90 degree angle to each other. The container in this configuration may be a parallelepiped.

Another feature for providing the advantages of the present invention is a line of weakness P in the material from which the container is constructed. The line of weakness P can start near the distal end of the first side panel top flap 30, then travel around the container 6, and terminate near the distal end of the second side panel top flap 40. For example, in the preferred embodiment shown in FIGS. 1 and 2, the line of weakness P starts near the distal end of the first side panel top flap 30 at a distance B from the first vertical fold line 14 and extends near to the first side panel top fold line 31, thus forming a first vertical section 32. (The distance B is preferably approximately equal to the front panel width A.) The line of weakness P further extends generally along the first side panel top fold line 31 to near the first vertical fold line 14, forming a first horizontal section 33. Further, the line of weakness P extends generally along the first vertical fold line 14 at a distance which is preferably less than the height of the front panel E, forming a second vertical section 13. Then, the line of weakness P extends laterally along, and optionally across, the front panel 15 to near the second vertical fold line 16, forming a lateral section 19. Further, the line of weakness P extends generally along the fold line 16 to near the second side panel top fold line 41, forming a third vertical section 17, and extends generally along the second side panel fold line 41 at a distance B, forming a second horizontal section 43. Finally, the line of weakness P continues to near the distal end of the second side panel top flap 40, forming a fourth vertical section 42. (By vertical or horizontal sections is meant the position of the sections as viewed in the figures.)

Figure 14:
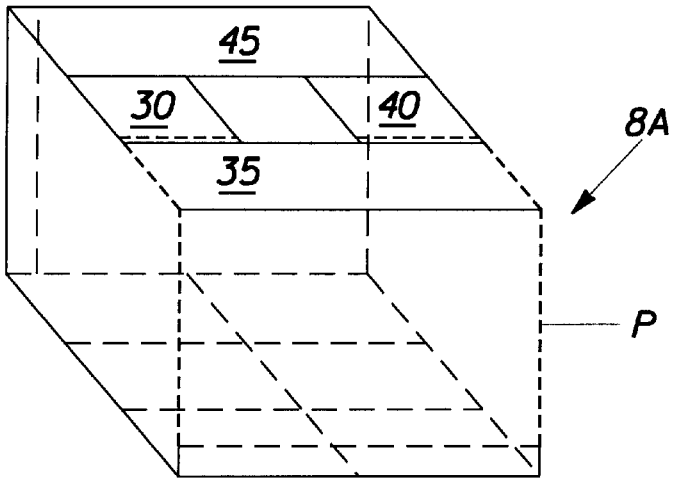
Figure 15:
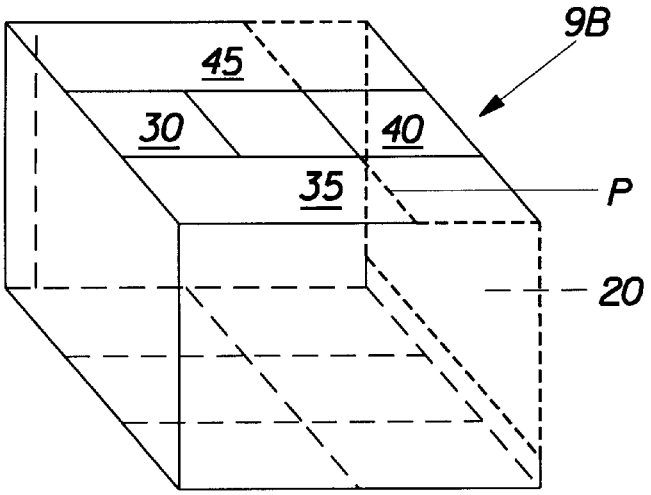
Figure 16:
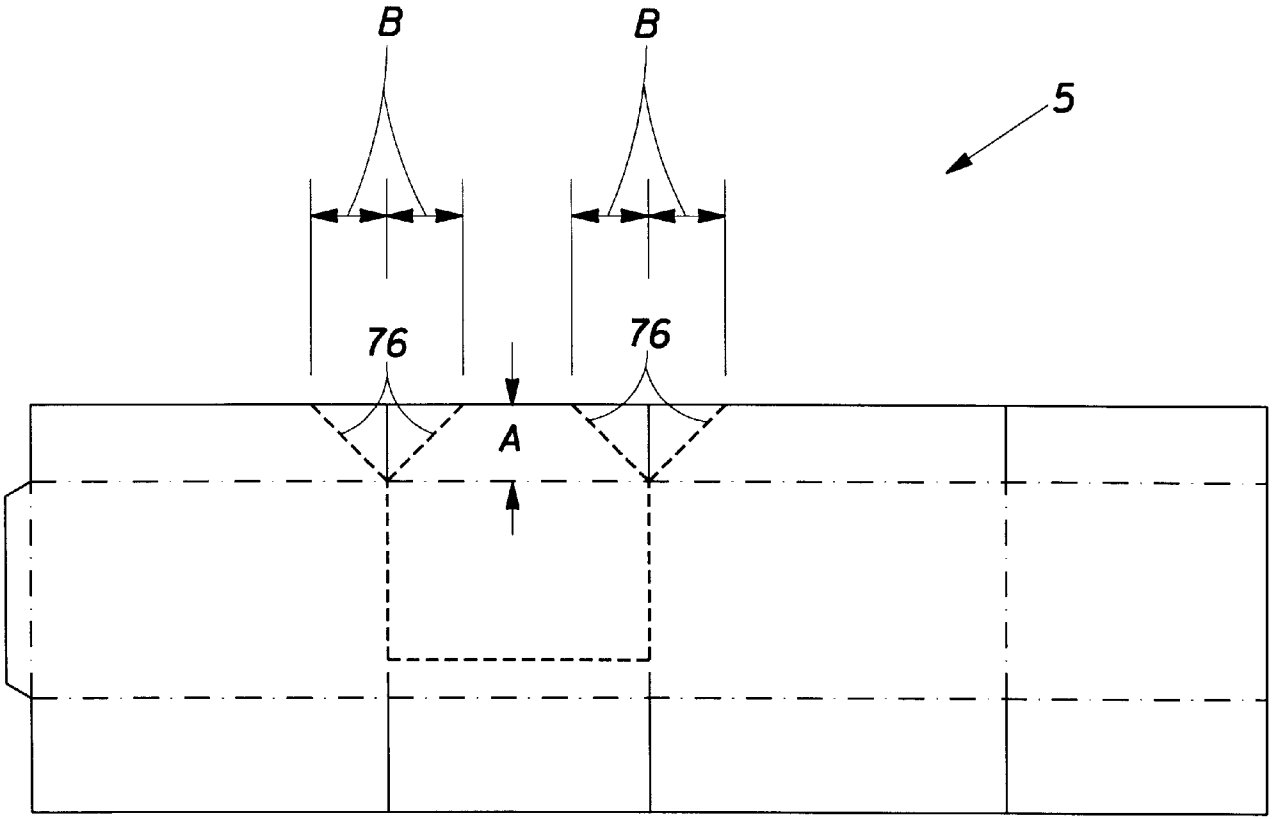
FIG. 16 is a plan view of a carton blank for the container shown in FIG. 4.

The carton blank 3, as depicted in FIG. 1, is preferably formed into a closed container 6, as depicted in FIG. 2, by joining the flap 12 to the rear panel 25 so as to form a hollow sleeve. Joining may be accomplished with adhesives, staples, heat bonding, ultrasonic bonding, or any other means known in the art. The front panel bottom flap 55 and the rear panel bottom flap 65 are then folded ninety degrees inward, and preferably with adhesive is applied thereto, followed by folding the first side panel bottom flap 50 and the second side panel bottom flap 60 in order to become joined to the front and rear bottom panel flaps 55 and 65. The front panel top flap 35 and the rear panel top flap 45 are folded ninety degrees inward and preferably adhesive is applied thereto, followed by folding the first side panel top flap 30 and the second side panel top panel 40 over and into contact with flaps 35 and 45 in order to become joined thereto, and, thus, forming a flap gap flap F between the oppositely located distal edges of the flaps 35 and 45. It should be noted that the flaps described above can be folded in any order, and glue can be applied accordingly to that order. For example, the first side panel top flap 30 and the second side panel top panel 40 can be folded first and adhesive applied thereto, and then the front panel top flap 35 and the rear panel top flap 45 can be folded and joined thereto, as depicted, for example, in FIGS. 14 and 15. Further, adhesive can be applied to any flap at any point during any step of the folding process. It also should be noted that any suitable means for joining the above flaps in the assembled condition may be used, for example, tape, staples, heat or ultrasound bonding, or adhesives, of which hot melt adhesives are generally preferred. FIG. 2 depicts the container 6 in a fully folded condition.

Figure 3:
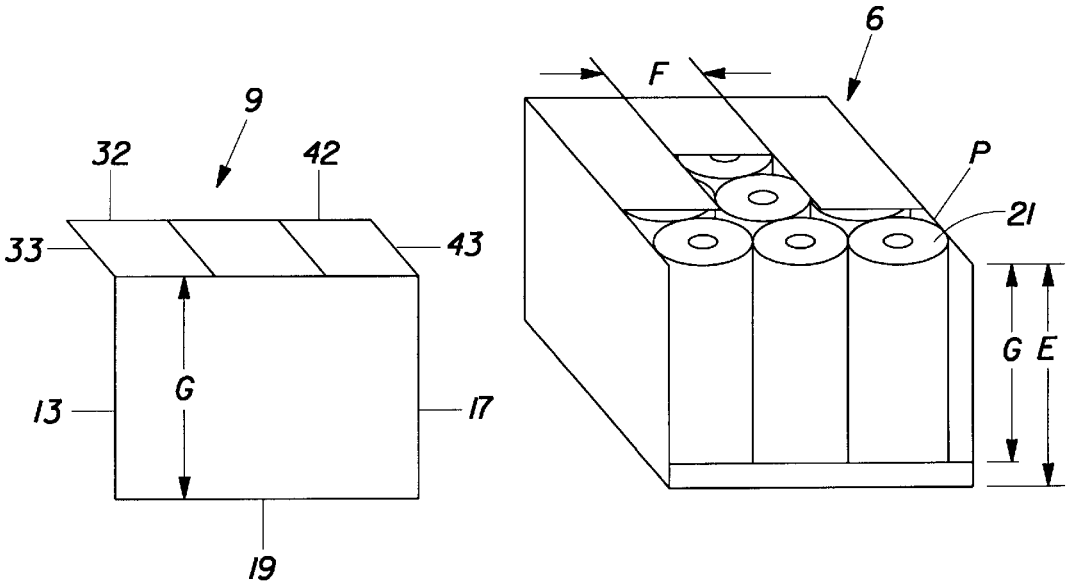
FIG. 3 is a perspective view of the container of FIG. 2 having a removable segment removed for displaying articles therein.

To open the container 6 for access to the product therein, as shown in FIG. 3, the consumer or any person, who are to remove the container contents for stocking at the point of purchase or place the container with products for a display, grasps the front panel top flap 35 in the gap flap area F and pulls upwardly so as to tear the front panel removable segment 8 free along the line of weakness P shown as the sections 32 and 42, 33 and 43, 13 and 17, and 19.

Figure 4:
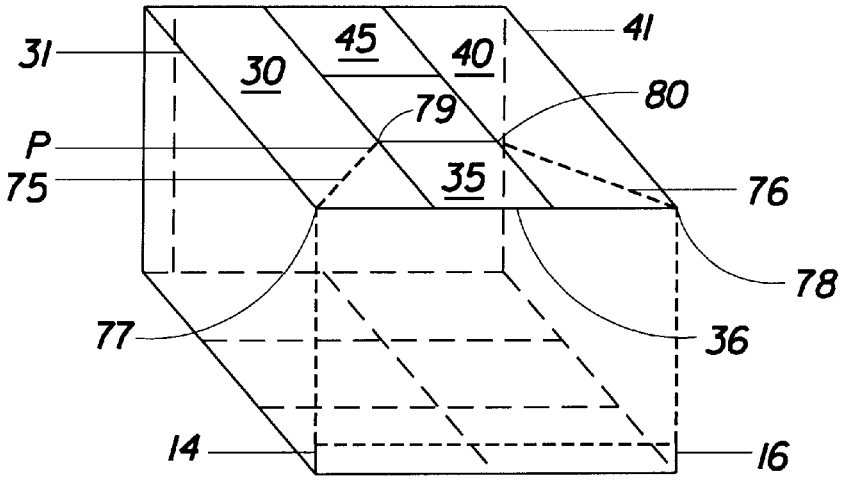
FIGS. 4–15 illustrate perspective views of alternative embodiments of the container of the present invention.

It should be noted that the front panel removable segment 8 can have many shapes formed by various paths that can be taken by the line of weakness P which preferably starts near the distal end of the first side panel top flap 30, then travels around the container 6, and ends near the distal end of the second side panel top flap 40. For example, FIGS. 4–16 depict some of the various paths which the line of weakness P can take. FIG. 4 depicts the line of weakness P having sections 75 and 76 extending from near flap junctions 79 and 80, respectively, to near corners 77 and 78, respectively. The flap junctions 79 and 80 are located in the intersections of the distal end of the front panel top flap 35 with the distal ends of the first and second side panels top flaps 30 and 40, respectively.

The corners 77 and 78 are formed by intersecting fold lines 14, 31, 36 and 16, 41, 36, respectively. Further, it should be noted that the line of weakness sections 75 and 76 extend not only in the first and second side panel top flaps 30 and 40, but also in the front panel top flap 35.

Figure 5:
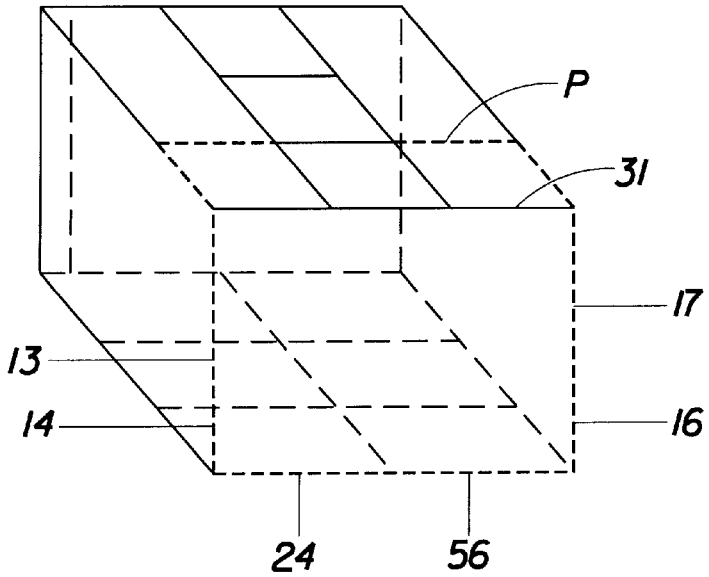
Figure 6:
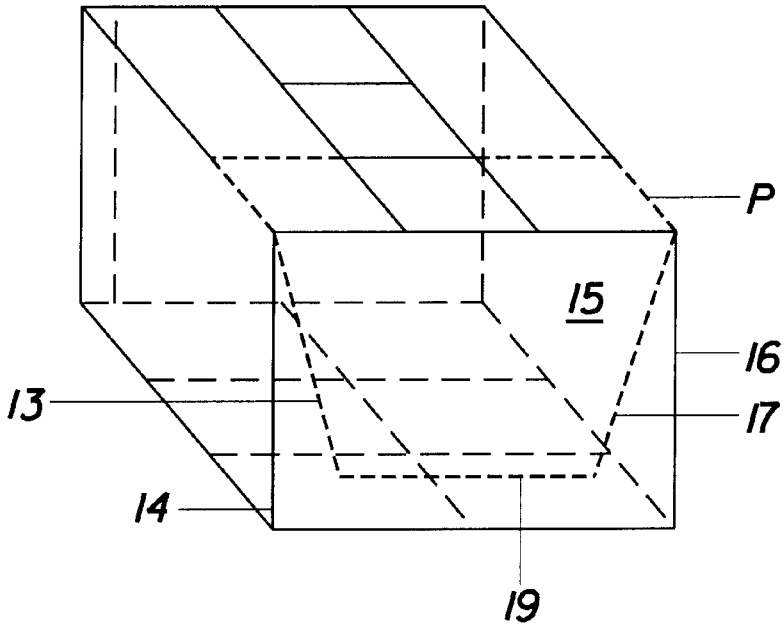
Figure 7:
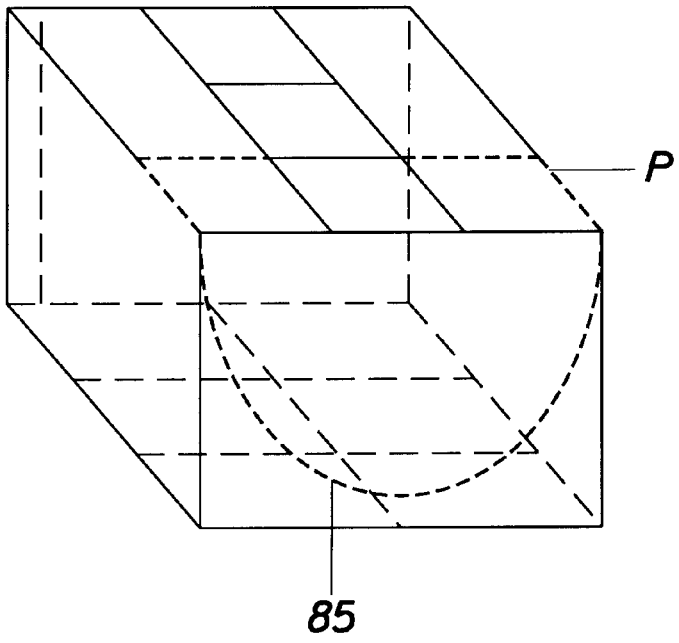
Figure 8:
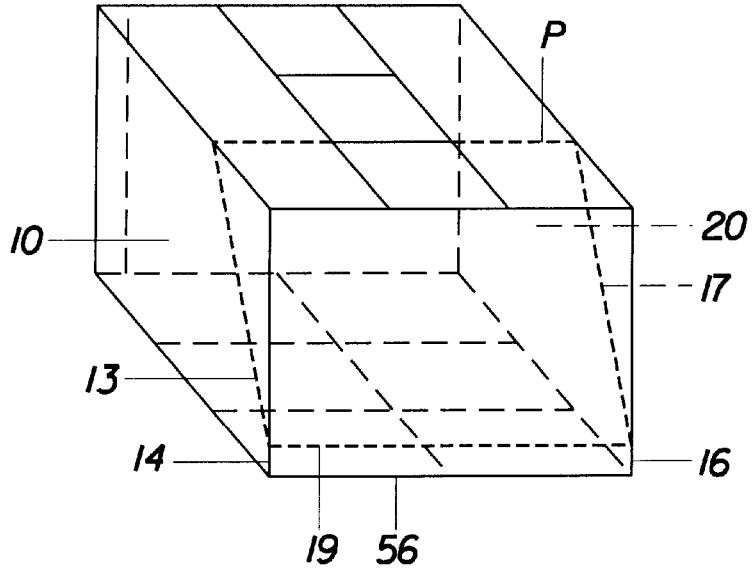
Figure 9:
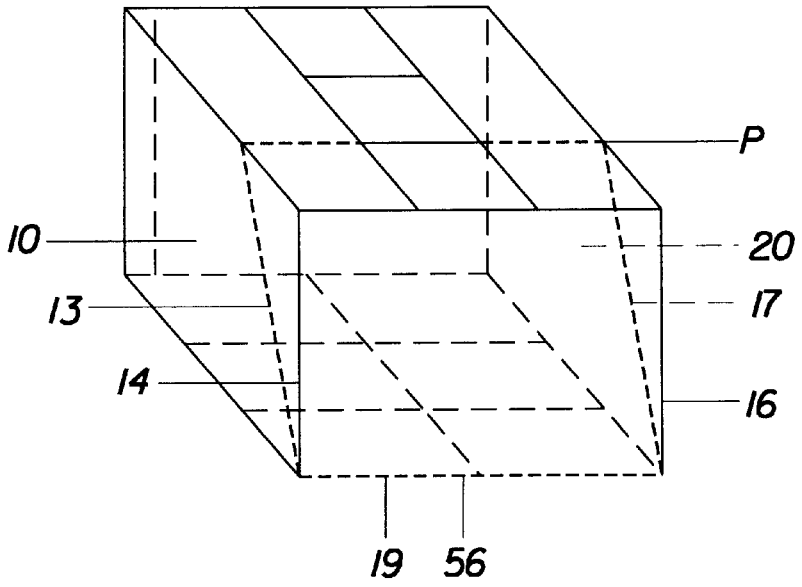
Figure 10:
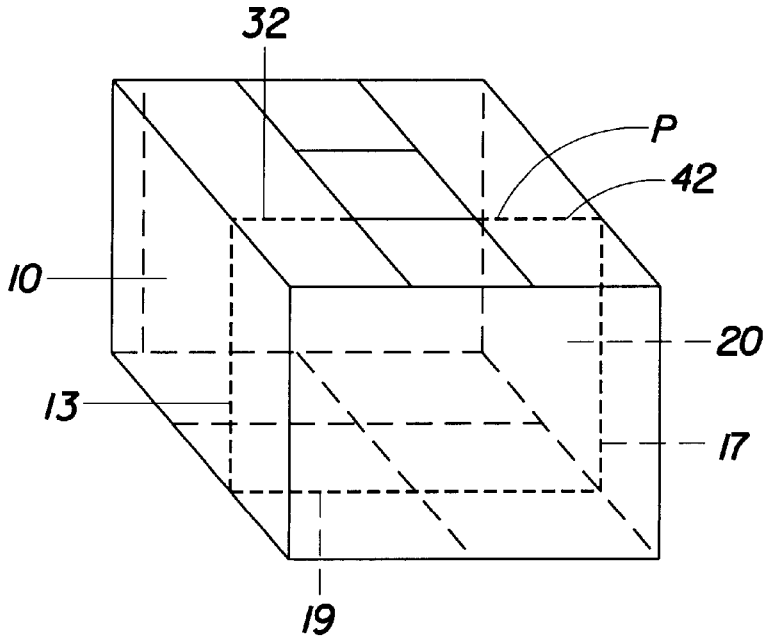

In an alternative embodiment to the second and forth vertical sections 13 and 17 extending along the fold lines 14 and 16, respectfully, at a partial height of the front panel 15, as depicted in FIG. 2, the vertical sections 13 and 17 can extend to the full height of the front panel 15, as depicted in FIG. 5. Even further, the second and third vertical sections 13 and 17 do not have to extend along the fold lines 14 and 16 but can extend in the front panel 15, as shown, for example, in FIGS. 6 and 7, or they can extend in the first and second side panels 10 and 20, as shown in FIGS. 8, 9, and 10. Depending on the height and position of the vertical sections 13 and 17, the lateral section 19 can extend above the fold line 56, as shown in FIG. 2, or substantially along the fold line 56, as shown in FIG. 5, or in the bottom of the box as shown in FIG. 10.

Figure 11:
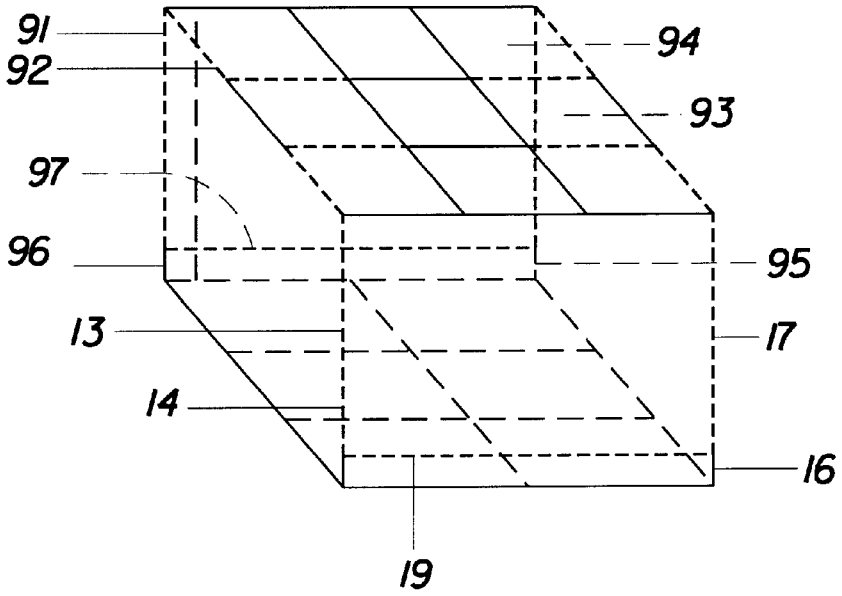
Figure 12:
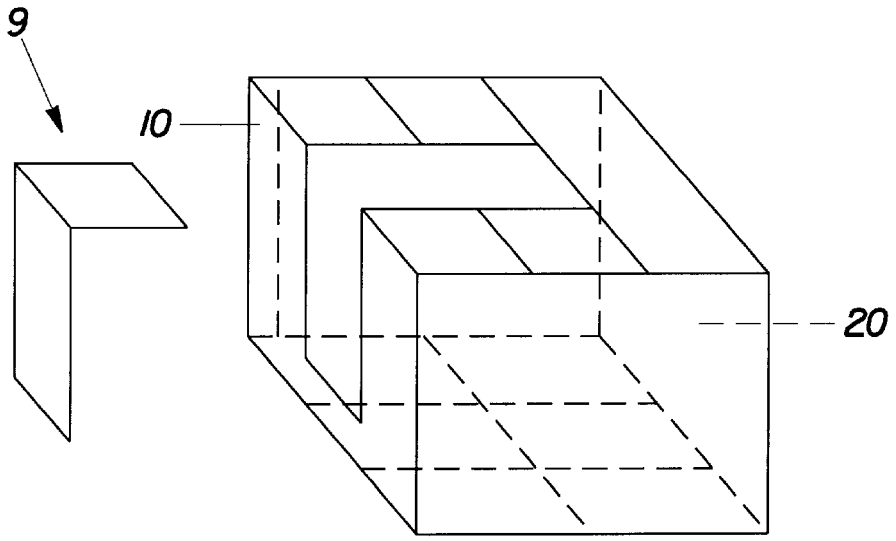
Figure 13:
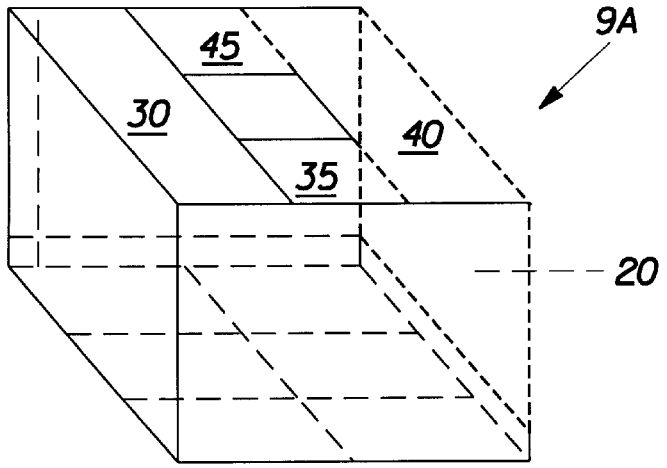

It should be noted that the alternative paths of the line of weakness P described above can be mirrored on the opposite side of the container, wherein a removable segment includes a rear panel, as shown, for example, in FIG. 11. It should be also noted that a removable segment can include not only a front and/or back panels but also one or two side panels, including a partial width or a full width of a panel. For example, FIG. 12 depicts a removable segment 9 which includes a partial width of the first side panel 10, and FIG. 13 shows a removable segment 9A which includes a full width of the second side panel 20.

The line of weakness P preferably exhibits sufficient strength to survive shipping and handling of the container without premature rupture while remaining sufficiently easy to rupture to facilitate opening and leave a reasonably well defined opening upon removal of a removable segment. An example of a removable segment is shown in FIG. 3 as a segment 8. Each section of the line of weakness P preferably includes a plurality of successive perforations. (Other alternatives for the line of weakness P may include slits, chemically or mechanically weaken areas, etc.) Each perforation preferably includes a cut followed by a skip. A cut is a penetration or a series of penetrations through or substantially through the thickness of the material. A skip is an uncut length in the material. Each section of the line of weakness P preferably starts and ends with a cut, and the sections are preferably connected to each other by the cuts. The line of weakness P can include cuts and skips which are of any shape or size. For example, the cuts and skips may be straight or curved, and suitable lengths of the cuts and the skips may be approximately ¼ to approximately 1 inch long for the cuts and approximately 1/16 to approximately ⅜ inch long for the skips. Preferable lengths may be approximately ½ inch long for the cuts and 3/16 inch long for the skips.

FIG. 3 depicts the container 6 in a partially loaded configuration, i.e. with a plurality of products 21 inside of the container. As shown in FIG. 3, the products 21 preferably fit into the interior of the container 6 in orderly fashion. The container 6 is particularly suited to contain products having a height substantially equal to the height E of the container, although products of any size less than the overall interior volume of the container may be contained therein in any suitable orientation. It should be understood that, as used herein, the term "product" is intended to encompass not only individual items, but also individual containers which enclose a product or products in liquid, powdered, granular, particulate, or discrete forms. Accordingly, containers according to the present invention may contain a single individual product, but are particularly suitable for containing a plurality of products which may themselves be containers of individual products.

The container 6, in the several figures herein, may be constructed in any desired dimensions, depending upon the particular product or products to be contain therein. Further, the proportions of the container may also be varied as desired to suit the proportions of the products and the desired overall container shape. Still further, the container may include symmetrical flaps (where flaps are the same size) or asymmetrical flaps (where flaps are differently sized). If the flaps are asymmetrical, the flap gap will be offset from the center of the container. Even further, the flap gap may be formed between a single (very large ) flap and the edge of the container.

The container 6, as shown in the figures herein, may be fabricated from a wide variety of suitable materials including, but not limited to, paper, cardboard (corrugated and otherwise), wood, metal, plastic, or any combination thereof For reasons of strength, economy, and convenience of opening, presently preferred materials for containers, according to present invention, include corrugated cardboard, for example, 125 pound weight cardboard.

While particular embodiments and or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. A container for shipping, display, and subsequent removal of at least one of a plurality of articles, said container having a plurality of panels and comprising:

a first surface, said first surface having a first pair of flaps comprising two oppositely extending flaps folded towards each other, each of said flaps having a proximal end and a distal end, said oppositely disposed distal ends of said flaps being oriented towards and spaced apart from each other to form a flap gap therebetween, said container further comprising a line of weakness having two ends, each end being juxtaposed with at least one of said distal ends of said flaps, said line of weakness extending therefrom to intercept at least one of said plurality of panels of said container adjacent one of said flaps; and a second pair of flaps oppositely extending towards each other and having the distal ends thereof spaced apart to form a second flap gap therebetween, said second flap gap intercepting said flap gap formed by said first pair of flaps, said first pair of flaps and said second pair of flaps overlaying one another to form at least two junctions, said line of weakness intercepting said two junctions, wherein said container is parallelepipedly shaped, said first and second pairs of flaps on said first surface are oriented 90 degrees from each other and form two pairs of junctions, said line of weakness intercepting both ends of one pair of junctions and wherein said line of weakness intercepts at least two adjacent surfaces of said container.

2. The container according to claim 1 wherein said line of weakness intercepts at least four adjacent surfaces said container.

3. The container according to claim 1 wherein said line of weakness intercepts at least five adjacent surfaces said container.

4. The container according to claim 1 further comprising a second pair of two oppositely disposed junctions formed by said second pair of flaps and a second line of weakness, said second line of weakness intercepting each of said two junctions of said second pair of two oppositely disposed junctions.

5. The container according to claim 4 wherein said second line of weakness is a mirror image of said first line of weakness.

6. A carton blank formable into a container for shipping, display, and subsequent removal of a plurality of articles therefrom, said carton blank having, in order, a first side panel, a front panel having a width, a second side panel, and a rear panel, said panels being connected together by spaced apart fold lines, said panels being fastenable so as to form a sleeve, at least one of said panels having a bottom flap foldably connected to said panel suitable for forming a bottom of said container, said container blank comprising:

(a) a plurality of top flaps, each said top flap being connected to one of said first side, front, second side, and rear panels by a fold line, each of said top flaps having a proximal and a distal end, said plurality of top flaps having a width between said proximal and said distal ends, said width being less than about half of said width of said front panel; and (b) a line of weakness having two ends, each end of said line of weakness being juxtaposed with at least one of said distal ends of said top flaps, said line of weakness extending therefrom to intercept at least one adjacent panel of said carton blank, wherein said line of weakness is juxtaposed with at least two of said distal ends of said top flaps and extending therefrom to intercept at least one adjacent panel.

7. The carton blank according to claim 6 wherein said line of weakness intercepts at least two adjacent panels.

8. The carton blank according to claim 7 wherein said panels are generally rectangular body panels.

9. The carton blank of claim 8 wherein said width of said plurality of said top flaps is at least 1 inch less than about one half of said width of said front panel.

10. The carton blank of claim 8 wherein said width of said plurality of said top flaps is at least 2 inches less than about one half of said width of said front panel.

11. A carton blank comprising:

(1) a first side panel;

(2) a front panel connected to said first side panel by a first vertical fold line, said front panel having a width;

(3) a second side panel connected to said front panel by a second vertical fold line;

(4) a rear panel connected to said second side panel by a third vertical fold line;

(5) a first side panel top flap connected to said first side panel by a first side panel top fold line, said first side panel top flap having a proximal end and a distal end, said first side panel having a width less than half of said front panel width;

(6) a front panel top flap connected to said front panel by a front panel top fold line, said front panel top flap having a width less than half of said front panel width;

(7) a second side panel top flap connected to said second side panel by a second side panel top fold line, said second side panel top flap having a width less than half of said front panel width;

(8) a rear panel top flap connected to said rear panel by a rear panel top fold line;

(9) a first side panel bottom flap connected to said first side panel by a first side panel bottom fold line;

(10) a front panel bottom flap connected to said front panel by a front panel bottom fold line;

(11) a second side panel bottom flap connected to said second side panel by a second side panel bottom fold line;

(12) a rear panel bottom flap connected to said rear panel by a rear panel bottom fold line; and

(13) a line of weakness comprising a multiplicity of sections, wherein (a) a first vertical section extends from near said distal end of said first side panel top flap to said first side panel top fold line approximately perpendicular to said first side panel top fold line at a distance approximately equal to said front panel top flap width;

(b) a first horizontal section extends from near said first vertical section generally along said first side panel top fold line to near said first vertical fold line;

(c) a second vertical section extends from near said first horizontal section to a lateral section extending between near said first vertical and said second vertical fold lines;

(d) a third vertical section extends from near said lateral section to near front panel top fold line; and (e) a second horizontal section extends from near said third vertical section generally along said second side panel top fold line at a distance approximately equal to said front panel top flap width.

12. The carton blank according to claim 11 wherein said line of weakness comprises a plurality of successive perforation sections, each perforation section comprising a cut followed by a skip.

* * * * *